US009681739B2

(12) United States Patent
Killion

(10) Patent No.: US 9,681,739 B2
(45) **Date of Patent: *Jun. 20, 2017**

(54) PACK STRAP HOOD

(71) Applicant: Bernard J. Killion, Louisville, KY (US)

(72) Inventor: Bernard J. Killion, Louisville, KY (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/756,475

(22) Filed: Sep. 8, 2015

(65) Prior Publication Data

US 2016/0135574 A1 May 19, 2016

Related U.S. Application Data

(63) Continuation-in-part of application No. 13/134,593, filed on Jun. 13, 2011, now Pat. No. 9,125,477.

(51) Int. Cl.

| | |
|---|---|
| ***A45F 4/02*** | (2006.01) |
| ***A45F 3/04*** | (2006.01) |
| ***A45F 4/12*** | (2006.01) |
| ***A41D 15/04*** | (2006.01) |
| *A45F 3/00* | (2006.01) |

(52) U.S. Cl.

CPC ..... *A45F 4/12* (2013.01); *A41D 15/04* (2013.01); *A45F 3/04* (2013.01); *A41D 2200/20* (2013.01); *A45F 2003/003* (2013.01)

(58) Field of Classification Search

CPC ..... A45F 4/12; A45F 2003/003; A45F 3/04; A41D 15/04

USPC ..... 224/576, 647, 153, 577, 645; 150/109

See application file for complete search history.

(56) References Cited

U.S. PATENT DOCUMENTS

| | | | | |
|---|---|---|---|---|
| 2,129,454 | A | 9/1938 | Wilkie | |
| 2,136,380 | A | 11/1938 | Garrison | |
| 2,136,393 | A | 11/1938 | Nelson | |
| 3,929,143 | A | 12/1975 | Coleman | |
| 4,389,735 | A | 6/1983 | McLaughlin | |
| 4,563,777 | A | 1/1986 | Park | |
| 5,165,111 | A | 11/1992 | Lieberman | |
| D339,912 | S | 10/1993 | Delauter | |
| 5,407,112 | A | 4/1995 | Christodoulou et al. | |
| 5,673,836 | A * | 10/1997 | Bush | A41D 13/00 2/94 |

(Continued)

*Primary Examiner* — Adam Waggenspack
*Assistant Examiner* — Lester L Vanterpool
(74) *Attorney, Agent, or Firm* — Carrithers Law Office, PLLC

(57) ABSTRACT

A shoulder strap pack is provided for carrying school supplies, camping equipment, tools or the like. At least one of the pack straps includes a loop or sleeve cooperatively engaging at least one of the pack straps. The loop or sleeve includes a resealable compartment for storing a hood or a portion of a hood therein. To use the hood, the user opens the compartment in the backpack strap loop or sleeve, and pulls out an attached hood or portion of a hood. The entire hood may be disposed within a compartment formed in a single sleeve or a pair of mating sleeves may be secured to opposing straps of a backpack, wherein each sleeve include a mated portion or half of the attached hood which can be joined via a connecting means such as a zipper. After use, the hood can be stored in the compartment of the sleeve of the pack strap. The hood may include a tie for fastening the hood around the user's head and under the chin.

7 Claims, 6 Drawing Sheets

(56) References Cited

U.S. PATENT DOCUMENTS

| | | | | | |
|---|---|---|---|---|---|
| 5,676,293 | A * | 10/1997 | Farris | A45F 3/04 | 2/175.7 |
| 5,743,448 | A | 4/1998 | Tsai | | |
| 5,909,802 | A * | 6/1999 | Puco | A45F 3/04 | 2/102 |
| 6,134,712 | A | 10/2000 | Spector | | |
| 6,843,398 | B2 | 1/2005 | Zion | | |
| 6,886,726 | B1 | 5/2005 | O'Hare | | |
| 7,363,659 | B1 | 4/2008 | Colbert | | |
| D619,802 | S | 7/2010 | Hedaya | | |
| 9,125,477 | B2 * | 9/2015 | Killion | A45F 4/12 | |
| 2003/0062391 | A1 | 4/2003 | Mitchell | | |
| 2003/0205593 | A1 | 11/2003 | Lavelle | | |
| 2005/0056669 | A1 | 3/2005 | Lavelle | | |
| 2006/0130220 | A1 | 6/2006 | Morgan et al. | | |
| 2007/0045369 | A1 | 3/2007 | Chen | | |
| 2009/0272773 | A1 | 11/2009 | Andrade | | |
| 2009/0283564 | A1 | 11/2009 | Bass | | |
| 2010/0078457 | A1 * | 4/2010 | Pitchford | A42B 1/048 | 224/576 |
| 2012/0045597 | A1 * | 2/2012 | Ponce | A45F 3/00 | 428/34.1 |
| 2013/0233661 | A1 * | 9/2013 | Scott | A45C 7/0086 | 190/102 |

* cited by examiner

PACK STRAP HOOD

CROSS REFERENCE TO RELATED APPLICATIONS

This application is a continuation-in-part of U.S. Pat. No. 9,125,477 issued on Sep. 8, 2015 from U.S. application Ser. No. 13/134,593 filed on Jun. 13, 2011 which is incorporated herein in its entirety.

TECHNICAL FIELD

The present invention relates to shoulder strap packs for carrying articles and in particular to backpacks which include at least one detachable strap sleeve having an integral attached hood removably stored therein.

BACKGROUND OF THE INVENTION

Backpacks and packs for carrying articles using shoulder straps provide a convenient resource for carrying heavy or cumbersome loads and have been used in one form or another for centuries. Users have commonly used packs to carry camping gear. Backpacks and book packs are conventional means for carrying school supplies by children and students and provide a way for school materials to be safely carried on their backs, leaving their hands free for other activities. Individuals can be involved in activities such as hiking or school related activities while wearing a backpack leaving their hands free and transferring the bulk of the load and weight to be supported by ones shoulders instead of the arms. College students and faculty as well make use of backpacks, book bags, duffle bags and the like which use shoulder straps to support the pack. A benefit of being able to participate in activities while wearing a backpack is that the children are able to closely monitor their belongings at all times. Thus, the likelihood that their belongings will be lost or stolen is greatly reduced. The backpack also provides an easy method of organizing and keeping up with all of the a user's belongings.

Whenever and for whatever purpose a backpack is used, a covering for the user's head is a desirable item or even a requirement for the user when foul weather catches the user outdoors. Some backpacks provide a hood which folds or rolls up and is stored in a compartment within the backpack. This method of storage uses space in the areas normally used to store other items. Further, if the hood is stored within the backpack compartment randomly with other items, getting the hood out and ready for use is delayed due to the fact that the hood is packed in among other items.

DESCRIPTION OF THE RELATED ART

Several patents provide storage within a particular pocket or compartment within the backpack but none has been seen which includes a compartment within the back straps suitable for storing a hood.

US Patent Publication No. 20100078457 by Pitchfork et al. for 'MULTI-FUNCTION BACKPACK-VEST DEVICE' which published on Nov. 5, 2009 teaches a backpack including pouch or compartment closed by a zipper or hook and loop fastener which contains a hood. The compartment is located at the top side of the backpack. Also included are small pockets on the back straps for carrying earphones or speaker wires which are connected to small speakers within the hood and which may be used with a small radio, MP3 player or the like. Pitchfork does not provide more efficient storage for the hood within the back straps as is provided for in the present application.

Other publications which teach methods of combining a hood with a backpack include: U.S. Pat. No. 4,389,735 by McLaughlin for 'CONVERTIBLE ARTICLE' which issued on Jun. 28, 1983; U.S. Pat. No. 4,563,777 by Park for 'COMBINATION CARGO PACK' which issued on Jan. 14, 1986; U.S. Pat. No. 5,165,111 by Lieberman for 'BACK-PACK WITH INTEGRAL GARMENT' which issued on Nov. 24, 1992; U.S. Pat. No. 5,407,112 by Christodoulou et al. for 'CONVERTIBLE BACKPACK' which issued on Apr. 18, 1995; and U.S. Pat. No. 5,676,293 by Farris for 'BACK-PACK AND METHOD OF USING SAME' which issued on Oct. 14, 1997. None of these provides for efficient storage of the hood within the back straps as is provided for in the present application utilizing a longitudinally split hood having a mating portion disposed in adjacent backpack straps as described by the instant invention.

SUMMARY OF THE INVENTION

In accordance with the present invention, there is provided a detachable sleeve including a hood pouch comprising, consisting of, or consisting essentially of a pocket made from a flexible, resilient material. The sleeve has a front side, a back side, and a zippered storage space therein. The sleeve pouch includes a hood storable within the pouch and affixed to an inner surface of the sleeve pouch. The sleeve pouch has attachment means fixed on a back side thereof allowing temporary attachment of the sleeve pouch to a carrying strap on a bag meant to be carried on the back of a user. When the sleeve pouch is attached near a top end of the carrying strap, the hood is deployable from the pouch and capable of covering a head of the user. The sleeve pouch may be slidably held upon a shoulder strap or include an elastic means or stretchable material or method of holding the sleeve in position at a selected point on the shoulder strap including a tie or grip enhancing material or substance.

It is an object of this invention to provide a zippered sleeve pouch containing an attached one piece hood and means of attaching the sleeve to a carrying shoulder strap to a pack.

It is another object of this invention to provide a pair of sleeve pouches which are attachable to respective carrying shoulder straps of a pack wherein each pouch contains one half of a hood such that the two halves of a hood are assembled to one another with a zipper which is attached to each of the hood halves.

In accordance with the present invention, one embodiment of a backpack is provided for carrying school supplies, camping equipment, tools or the like, including a plurality of compartments for various items and particularly including a longitudinal compartment formed within each pack strap for storing a portion consisting of one half of a mating portion of a longitudinally split hood. Each longitudinal pack strap includes a resealable means for opening and closing a longitudinal opening or slit formed in the back surface of the strap adjacent the user which forms a compartment whereby an distal end of each end of each hood portion is integrally attached to the top of the pack at a selected position between the top attachment points of the pack straps. When inclement weather strikes, the user opens the compartment within each back strap, pulls out each half of the attached hood and joins the two hood halves together via a connecting means such as a zipper. The user then recloses the back strap compartments and puts the pack on using the shoulder straps whereby the hood extends from the top portion of the pack. The hood includes ties for fastening the hood around the user's head and under the chin.

One pack embodiment of the present invention comprises a backpack body comprising a front side and a back side connecting to a right side and a left side connecting to a bottom panel, and a top panel including an opening therein connecting to the front side, the back side, the right side and side left side, and a left backpack strap and a right backpack strap extending from the back side of the back pack. The left back strap comprising a longitudinal strip of tubular material defining hollow strap having a front side and a back side adjacent a user. The left back strap and the right back strap each one containing a longitudinal storage pocket disposed within the back side of the left back pack strap and the right backpack strap, the longitudinal storage pocket extending from the upper end of the strap a selected distance downward therefrom, each one of the pockets including a means for closure extending along the length of each of the longitudinal storage pocket. The left backpack strap and the right backpack strap having an upper free end attaching to an upper marginal edge of the backpack and a lower free end attaching to a lower edge of the backpack. A split hood comprising a left hood portion and a right hood portion releasably joined together by a means for closing extending from a front end to a rear end of the split hood, the split hood having a proximal bottom end attaching to an upper end of the back side of the backpack. Wherein disengaging the left hood portion from the right hood portion of the split hood forms a pair of disconnected split hood portions, each one disposable in the corresponding longitudinal pocket of said backpack strap for storage.

More particularly, a one preferred embodiment of the pack includes a hood which is stored within compartments contained in the back straps of the pack. The pack is conventional and has a front side, a back side, a right side, a left side, a top, a bottom, a left back strap, a right back strap and a hood, the pack including a plurality of storage compartments including closures. The left back strap has the upper free end rigidly attached at a position just to the left of the center of an upper marginal edge of a front side of the pack. The right back strap has the upper free end thereof rigidly attached at a position just to the right of the center of an upper marginal edge of a front side of the pack. The left back strap has a lower free end thereof rigidly attached to a lower left marginal edge of a front side of the pack, and the right back strap has a lower free end thereof rigidly attached to a lower right marginal edge of a front side of the pack. The hood comprises a left hood half, a right hood half and a hood zipper joining the halves. The left hood half has a right marginal edge and a top marginal edge thereof sown to a left side of the hood zipper. The right hood half has a left marginal edge and a top marginal edge thereof sown to a right side of the hood zipper, a lower marginal edge of the hood zipper being rigidly attached to the center of the upper marginal edge of the front side of the pack and adjacent to the upper ends of the back straps. The zipper is capable of holding the left hoof half and the right hood half together to form a hood configured to be worn on a user's head. The left back strap and the right back strap each contain a longitudinal compartment or longitudinal pocket extending from the upper ends, down along most of the length thereof The longitudinal pockets each includes a closing means such as a zipper extending along the length of each pocket thereof The pockets each are capable of containing the free portion for covering the head of one of the hood halves therein when the hood zipper is unzipped, thus allowing the t hood half to be tucked into the longitudinal pocket within the back strap and allowing the opposing hood half to be tucked into the pocket within the adjacent opposing back strap, whereupon each pocket within each back strap pocket is zipped closed.

The pack of the present invention provides hood storage within pockets in the back straps. Rather than providing a separate compartment within and near the top of the pack, which takes up needed storage space, a hood is stored in compartments which are an integral part of the back straps.

The hood is attached near the top of the pack and near the top attachment point for the back straps. Further, the hood comprises two halves which are joined for use by a zipper. Another embodiment includes a one piece hood which is removably attached to the pack. Besides providing space saving storage in the back straps, this approach provides much easier access to the hood when an immediate need arises, such as a cloudburst, because the back straps are exterior to the normal storage areas of the pack and are close at hand.

Another preferred embodiment comprises or consists of a backpack body comprising a front side and a back side connecting to a right side and a left side connecting to a bottom panel. The backpack may include a top panel, or the top and front panel may be integral in that the front panel connects directly to the marginal edges of the bottom panel, back panel, and left side panel, right side panel. The back panel includes at least one and typically two longitudinal vertical straps extending from the top to the bottom of the back panel which sometimes includes a reinforcement strip or panel of material at the attachment point of the straps to the back panel. The left and the right backpack straps include at least a portion thereof comprising a longitudinal strip of tubular material defining a hollow strap having a front side and a back side adapted to be adjacent a user. The left backpack strap and the right backpack strap each contain a longitudinal opening and resealable means for closure selected from the group consisting of a zipper, hook and loop fasteners, buttons and button holes, snaps, tongue and groove fastener, and overlapping flaps. The resealable means for closure extends along a selected length of the hollow strap defining a longitudinal storage pocket disposed within the left backpack strap and the right backpack strap. The longitudinal storage pocket extends from an upper end of the left backpack strap and the right backpack strap a selected distance downward therefrom. The left backpack strap and the right backpack strap have an upper free end attaching to an upper marginal edge of the backpack and a lower free end attaching to a lower edge of the backpack. A hood comprises a left hood portion and a right hood portion releasably joined together by a means for closing extends from a front end to a rear end of the hood. The hood has a proximal bottom end attaching to an upper end of the back side of the backpack. Disengaging the left hood portion from the right hood portion of the hood forms a pair of disconnected split hood portions, each one disposable in the corresponding longitudinal storage pocket of the left backpack strap and the right backpack strap for storage. Upon opening of the storage pocket of the left backpack strap and the right backpack strap, the left hood portion and the right hood portion are removable therefrom and releasably joined together forming a hood for covering the head of the user. A major portion of the longitudinal storage pocket is closeable and functions as a backpack strap.

The pack of the present invention includes a plurality of compartments commonly provided by most packs which are held closed with a closure such as a zipper, hook and loop fasteners or ties. Also included are space saving compartments along the length of or integral with the back straps which are intended to store the two halves of a hood which can be removed from the compartments and zipped together to form a single hood.

Another embodiment of the pack contains a one piece hood which is stored within a compartment in one of the back straps, leaving the compartment in the other back strap for storing other items.

A pouch sleeve or loop may also have a hood affixed within and including zippered or hook and loop closure. The sleeve or loop is configured for attachment to a carrying strap on a back pack, or other bag which is carried on a user's back. The sleeve contains a pocket with a zippered closure, and loops, snaps or velcro for fastening the pouch to the carrying strap on a back pack or other bag. When inclement weather strikes, the user opens the compartment within the zippered pouch and pulls out the attached hood. The hood may include a tie for fastening the hood around the user's head and under the chin. Another embodiment includes a pair of opposing sleeves wherein each one includes a half hood in each pouch, the two halves come out and include a zipper which can fasten the two halves together. The two pouches can each be fastened to respective ones of the two straps on a backpack.

As shown in the drawings, 5-11, a pack strap hood comprises or consists of a pack body comprising a front side or panel, a back side or panel, connecting to a right side or panel and a left side or panel, all of which connect to a bottom side or panel. A top side or panel may connect to the bottom panel, side panels and front panel, whereby the front panel includes an opening therein. The pack may also be constructed so that the front panel and top panel are of an integral construction, whereby the front panel typically attaches to the marginal edges of the bottom panel, and side panels and extends to the top of the back panel, and includes an opening therein. At least a top portion of the front side of the backpack includes an opening therein. At least one backpack strap extends from the back panel of the backpack. The strip may be vertically or diagonally disposed extending from the top to the bottom of the back panel. The backpack strap includes a sleeve attaching thereto comprising a longitudinal strip of tubular material containing a longitudinal storage pocket and resealable means for closure selected from the group consisting of a zipper, hook and loop fasteners, buttons and button holes, snaps, tongue and groove fastener, and overlapping flaps, the resealable means for closure extending along a selected length of the sleeve. A hood having a proximal bottom end attaches to an upper end of the sleeve. The hood is disposable in the longitudinal storage pocket of the backpack strap for storage. Upon opening the storage pocket of the at least one backpack strap the hood is removable therefrom for covering the head of the user.

Typically the backpack will include a pair of spaced apart generally vertically backpack straps. A hood containing sleeve may be permanently attached by sewing or other means or be removably attached whereby tabs or flaps may overlap and be removably connected by hook and loop fasteners (VELCRO), or other releasable means such as tape, a zipper, buttons or snaps.

As set forth and described heretofore, a pair of sleeves may be used and removably attached having cooperatively engaging hood halves which extend from the sleeves and are joined together by a zipper or other releaseable means for form a hood.

It is also an object of the present invention to provide for a loop or sleeve removably attachable to a strap of a backpack, book bag, or other shoulder bag or pack carried by a shoulder strap extending over the shoulder of a user comprising or consisting of a longitudinal strip of tubular material containing a longitudinal storage pocket and resealable means for closure selected from the group consisting of a zipper, hook and loop fasteners, buttons and button holes, snaps, tongue and groove fastener, and overlapping flaps, the resealable means for closure extending along a selected length of the sleeve. A hood having a proximal bottom end attaches to an upper end of the sleeve. The hood is disposable in the longitudinal storage pocket of the backpack strap for storage. Upon opening the storage pocket of the at least one backpack strap the hood is removable therefrom for covering the head of the user.

It is an object of this invention to provide a backpack including a hood which is comprised of two halves held together by a zipper and wherein the zipper and the two halves of the hood are permanently fastened to the top side of a backpack near the points where the upper ends of the back straps are attached to the backpack.

It is another object of this invention to provide a backpack including a hood which is comprised of two halves held together by a zipper and which is removably fastened to the top side of a backpack near the points where the upper ends of the back straps are attached to the backpack.

It is another object of this invention to provide a backpack including two space saving storage compartments, each within or integral with a back strap on the backpack for storing each of the two halves of the hood when the hood is not joined into one unit by having the zipper closed.

It is an object of this invention to provide an alternative backpack including a one piece hood which can be stored within a space saving compartment within or integral with a back strap on the backpack.

It is an object of the present invention to provide a hood which can be lined and/or insulated from heat or cold.

It is an object of the present invention to provide a hood which can composed of a light weight material to server as a wind breaker.

It is an object of the present invention to provide a hood which can be composed of a mesh or light weave to serve as protection from the sun and permit optimal ventilation.

It is an object of the present invention to provide a hood which can be moisture resistant or moisture repellant.

Other objects, features, and advantages of the invention will be apparent with the following detailed description taken in conjunction with the accompanying drawings showing a preferred embodiment of the invention.

BRIEF DESCRIPTION OF THE DRAWINGS

A better understanding of the present invention will be had upon reference to the following description in conjunction with the accompanying drawings in which like numerals refer to like parts throughout the views wherein.

DESCRIPTION OF THE PREFERRED EMBODIMENTS

In accordance with the present invention, there is provided a backpack 10 composed of natural or synthetic fabric, plastic, or leather or combinations thereof including a two piece hood 20 attached to the top of the backpack which can each be stored within compartments contained within the back straps of the backpack. It should be noted that the terms "panel" and "sides" are synonymous as set forth in the description hereafter.

Figure 1:
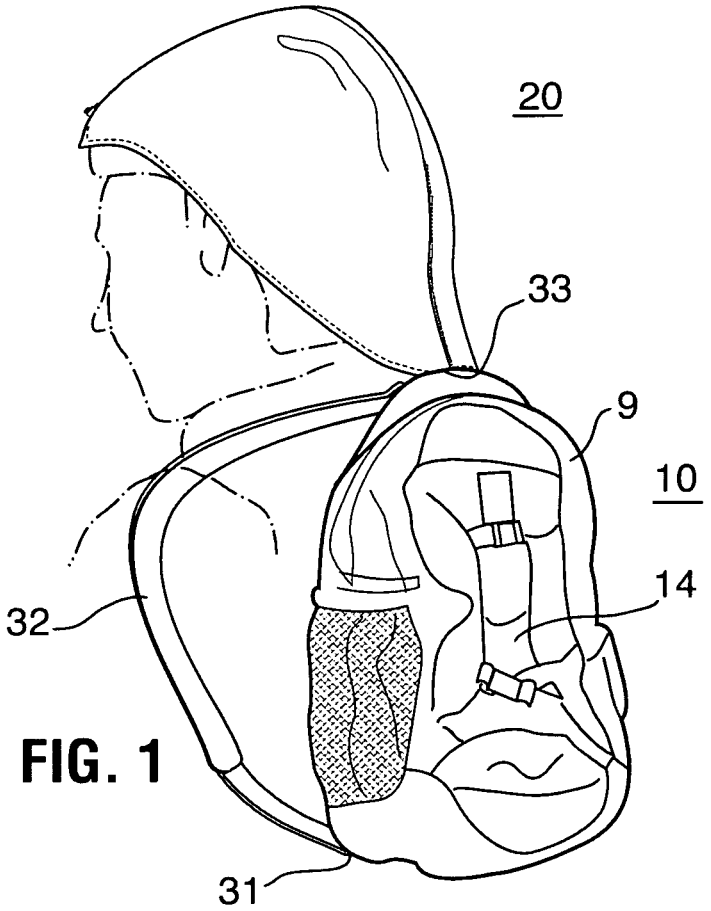
FIG. 1 is a perspective side view of the backpack with the hood assembled and being worn by a user.
Figure 3:
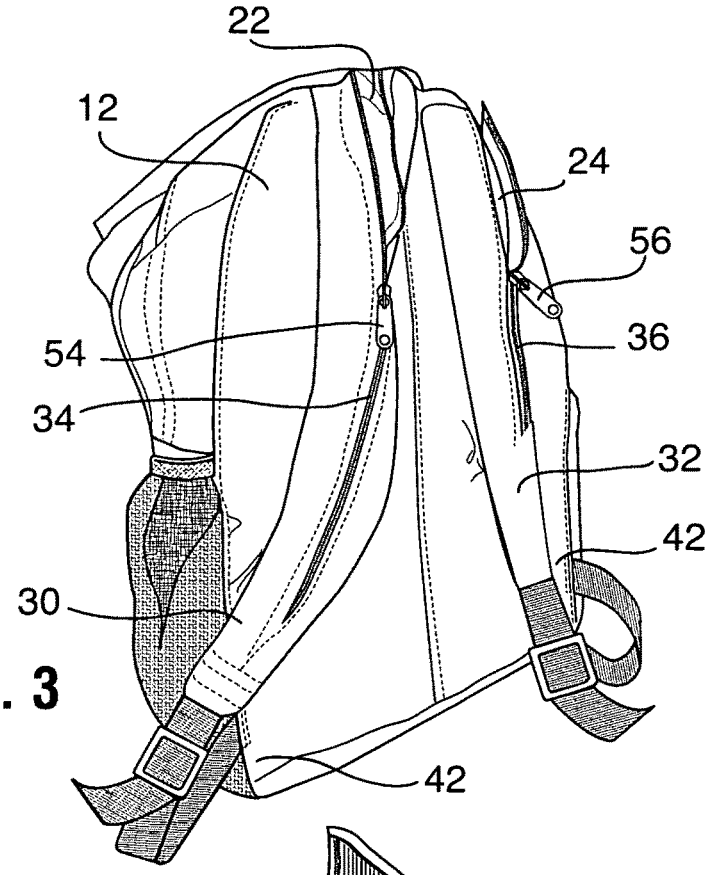
FIG. 3 is a perspective side view of the back pack with a hood compartment partially opened and the hood halves stored within the compartments
Figure 4:
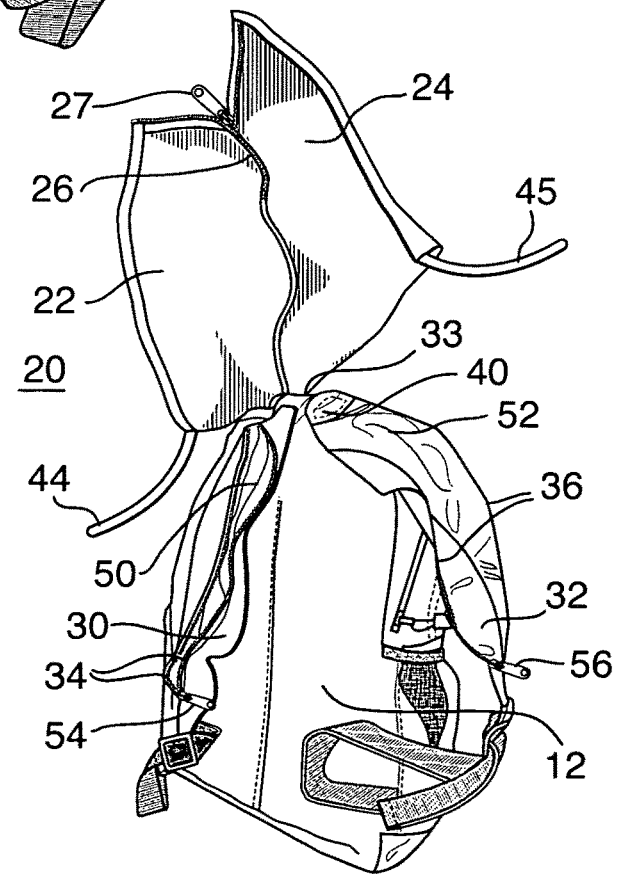
FIG. 4 is a perspective front view of the backpack with the hood partially assembled.

FIG. 1 shows the backpack 10 having a front side or panel 9 including a main storage compartment 14. In FIGS. 3 and 4, back straps 30 and 32 are attached to the upper and lower marginal edges of the back side 12 of backpack 10. Of course it is contemplated that the attachment point of the distal ends of the straps could be at the sides or top or bottom portions as well; however, the straps are typically attached at the marginal edges of the panels. As shown in FIG. 1, the proximate ends of the hood 20 are attached at the center of the upper marginal edge 33 of the back side 12 of backpack 10 disposed in between the straps and generally in alignment with the top attachment point of the backpack strap and is shown assembled and ready to use.

Figure 2:
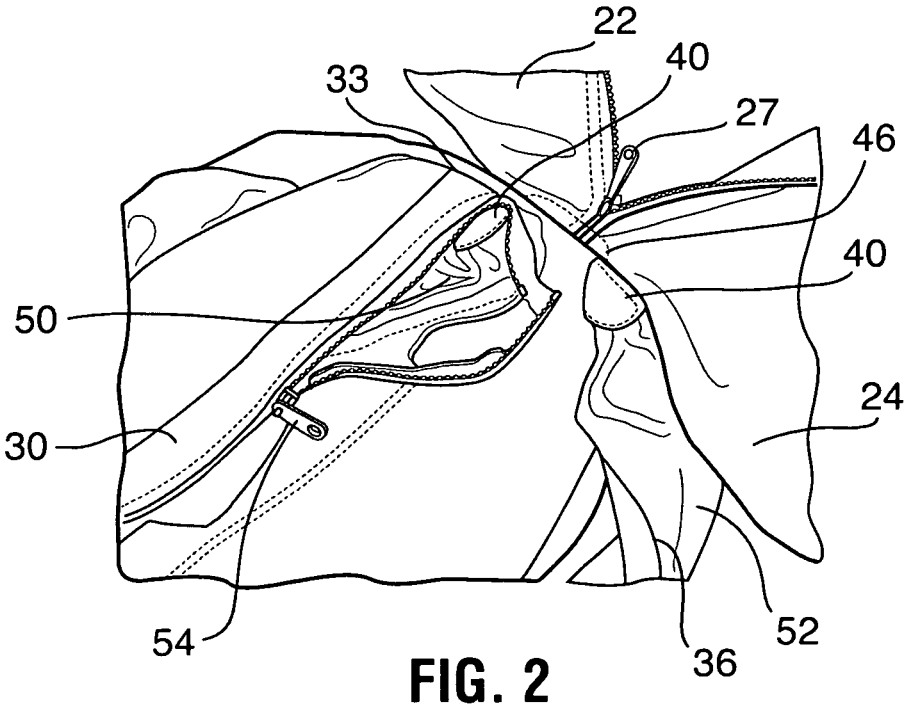
FIG. 2 is a perspective front view of the side of the backpack showing a partially opened hood compartment.

As shown in FIG. 4, a preferred embodiment reinforcing panel 40 comprised of leather or synthetic material is attached by stitching or adhesive to the upper end of the inside of compartment 52 of back strap 32. Of course, the reinforcement panel is optional and the hood can be attached directly to the exterior of the panel or material comprising the backpack body. Then, as a unit, leather panel 40 and the upper marginal edge of back strap 32 are stitched to the right of center of upper marginal edge 33 of the back side 12 of backpack 10. The upper end of back strap 30 also includes a reinforcing panel 40 which is shown in FIG. 2, and is attached just to the left of the center of the upper marginal edge 33 of the back side 12 of backpack 10. The lower free ends of back straps 30 and 32 include adjustable strap portions which are attached near the lower corners 42 of the back side 12 of backpack 10, as shown in FIG. 3.

As shown in FIGS. 2 and 4, each of back straps 30 and 32 includes a closure means located on the inside surface of the straps adjacent the user. As shown in the preferred embodiment, a pair of corresponding lockable strips comprising a zipper 21 are attached to each side of the longitudinal openings of slits formed in the surface of the backpack straps which are tubular or hollow in design and more particularly are formed from a single piece of material or fabric sewn together along a longitudinal seam providing a flattened profile depicting a hollow strap. Of course, it is contemplated that hook and loop fastener strips 53 such as sold under the trade name VELCRO could be used instead of zippers or in combination therewith. Moreover, snaps, buttons and button holes or loops could be utilized as strap closure means as well. In addition, the slits or longitudinal openings formed in the backpack straps could be lined with elastic or utilize a tongue and groove closure means such as interlocking plastic ridges. Finally, overlapping flaps on the underside portion of the backpack straps could provide sufficient retaining means to provide closure.

It is also contemplated that at least one additional strip of material comprising a longitudinal tubular member defining sleeve 23 could be removably affixed to a conventional backpack strap comprised of a single strip of material in order to provide a longitudinal storage compartment or pocket for storage of a two piece of split hood as described to be used in combination therewith. Moreover, the removable straps could include a split hood containable therein which could be linked together to form an integral hood and that the hood need only be connected at its proximate end to an upper end of the strap.

As illustrated in FIG. 4, interlocking zipper strips 34 and 36 are shown opened with zipper pulls 54 and 56, respectively, at the bottom of the zippers 34 and 36. In FIG. 4, the zippers are shown in an open unzipped state, and longitudinal compartments 50 and 52 are shown with the flaps spread apart in an open position. FIG. 4 also shows corresponding longitudinal hood halves 22 and 24 cooperatively engaged and zipped together to form an integral one piece hood . Also shown in FIG. 4, hood halves 22 and 24 each include a pull string or tie 44 and 45 at their respective lower free corners, for the purpose of tying hood 20 tightly under a user's chin. Of course, it is contemplated that hook and loop fastener strips such as sold under the trade name VELCRO could be used instead of zippers or in combination therewith. Moreover, snaps, buttons and button holes or loops could be utilized as strap closure means as well. In addition, the slits or longitudinal openings formed in the backpack straps could be lined with elastic or utilize a tongue and groove closure means such as interlocking plastic ridges. Finally, overlapping flaps on the underside portion of the backpack straps could provide sufficient retaining means to provide closure.

As shown in the figures a hood, or hood halves 22 and 24 are almost totally concealed within the zippered compartments of back straps 30 and 32, respectively. A small portion of hood halves 22 and 24 is exposed even when the zippers 34 and 36 are completely zipped, due to the fact that hood halves 22 and 24 and the lower marginal edge of zipper 26 are attached at a position outside of compartments 50 and 52 at a position at the center of upper marginal edge 33 of backpack 10 with stitching 46 shown in FIG. 2.

FIG. 2 shows a partial view of hood halves 22 and 24 with zipper pull 27 unzipped and with hood halves 22 and 24 almost completely apart from one another. It is anticipated that a user would zip compartments 50 and 52 closed anytime the backpack is being worn. When a user must quickly prepare the hood for wear, the backpack is removed. The back straps will be easily accessible so that the user can quickly unzip the back strap compartments zip the hood together, zip the back strap compartments closed, put on the backpack and hood and proceed.

The sleeve pouch 23 is shown in FIGS. 5-11 with a zippered closure 21 containing an attached deployable hood 20. The pouch 23 includes attachment means such as cooperatively engageable tabs or flaps 51, 55, 57 and 59 on the back side for attaching the sleeve pouch 23 to the carrying strap(s) 30, 32 of a backpack 10 or book bag 7, garment bag or other type of bag meant to be carried on the back of a user. The sleeve pouch 23 is preferably generally rectangular with the body extending outward in the middle when filled with the hood 20. With the sleeve pouch 23 attached to the carrying strap 30 of a bag 7, in the event of rain or other inclement weather, the user may simply unzip the sleeve pouch 23, deploy the hood 20, and place the hood 20 on his head.

Figure 7:
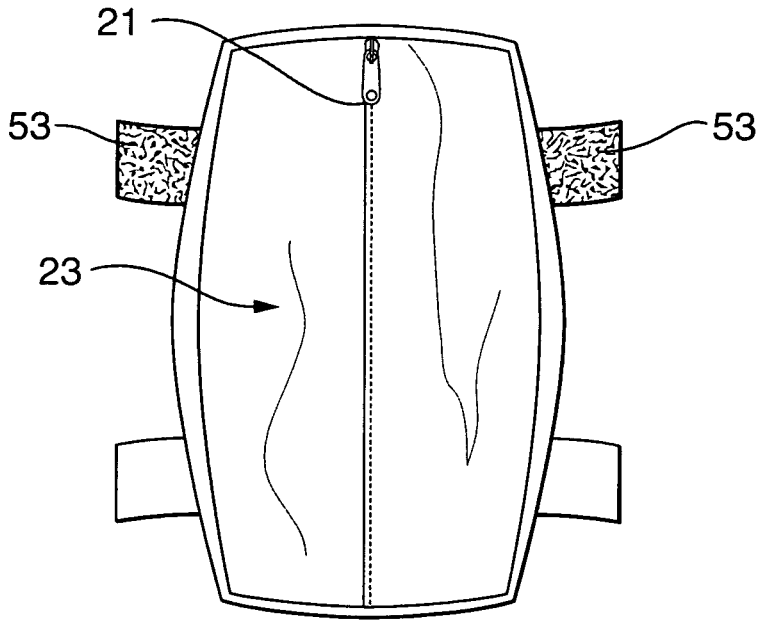
FIG. 7 is a perspective view of a backpack hood sleeve showing the cooperatively engaging and removable attachment tabs and a zipper for closing the storage pocket.

The preferred means of attachment holding the sleeve pouch 23 to the bag carrying strap 30 is hook and loop fasteners 53 on the tabs as shown in FIG. 7, or the attachment means can be sewn or glued or formed by molding or the like on the opposing marginal edges of the sleeve pouch 23 for wrapping the sleeve 23 around the strap 30.

Figure 9:
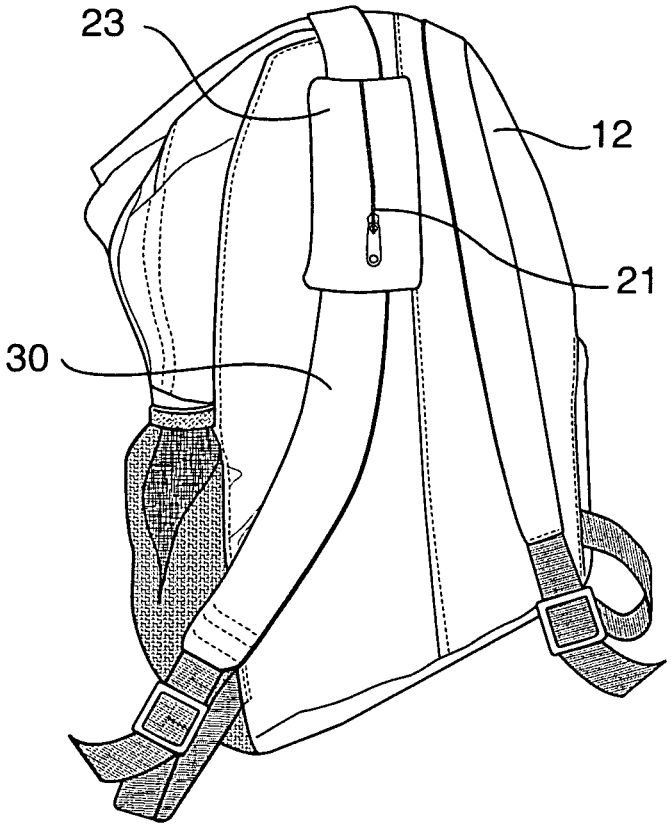
FIG. 9 is a rear view of the pouch containing the hood with the zippered closure closed.
Figure 10:
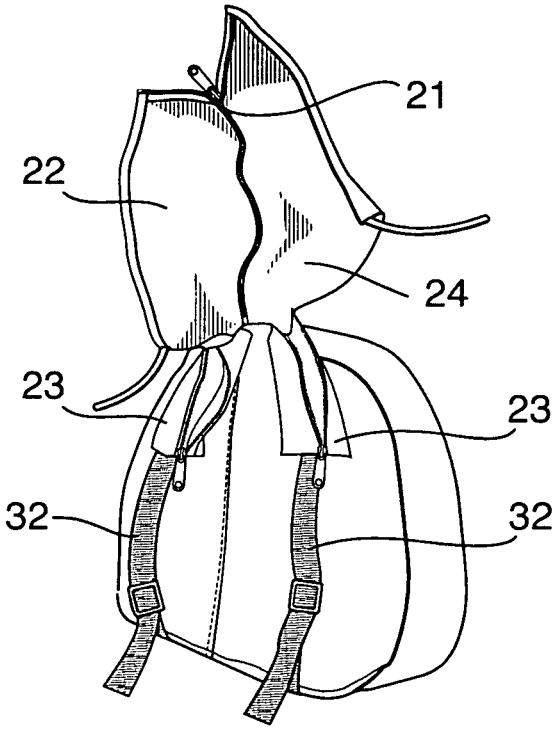
FIG. 10 is a perspective front view of a backpack with a sleeve attached to each strap and with the two part hood partially assembled.
Figure 11:
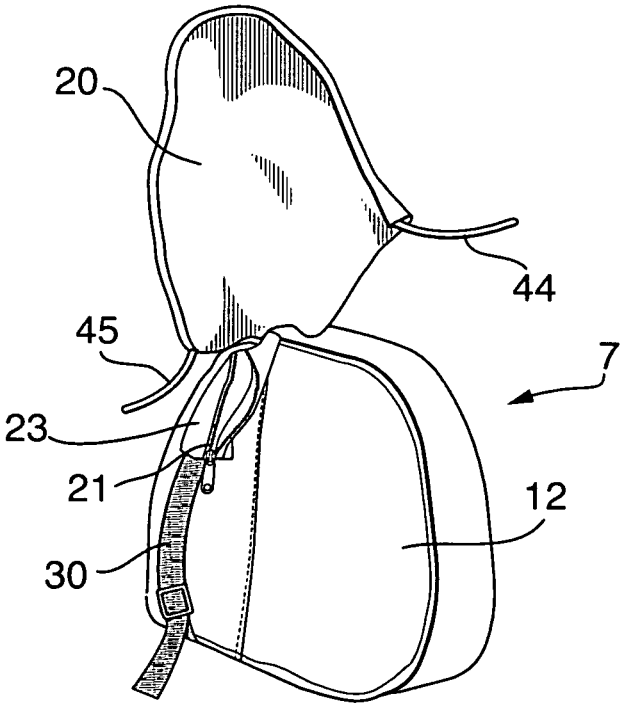
FIG. 11 is a perspective front view of a backpack and a sleeve attached to one of the carrying straps of a book bag showing the one part hood deployed from the pouch.

One preferred embodiment shown in FIGS. 9 and 11 has one sleeve pouch 23 with a one piece hood 20 contained therein. Another embodiment shown in FIGS. 5, 6, and 10 has two sleeve pouches 23, each containing one half of a two piece hood, hood half 22 and hood half 24, respectively. When the two halves are pulled from their pouches, the halves are assembled together by connecting and zipping the zipper 21. This two piece hood may be needed rather than a one piece hood if the user prefers a larger hood or a thicker hood with an increased amount of insulation which might not fit into one pouch. The hood is optionally provided with pull string 44, 45.

The pouch and the hood are preferably made of flexible and resilient material which is moisture resistant and machine washable. The hood preferably includes an insulating material providing heat retention.

Figure 5:
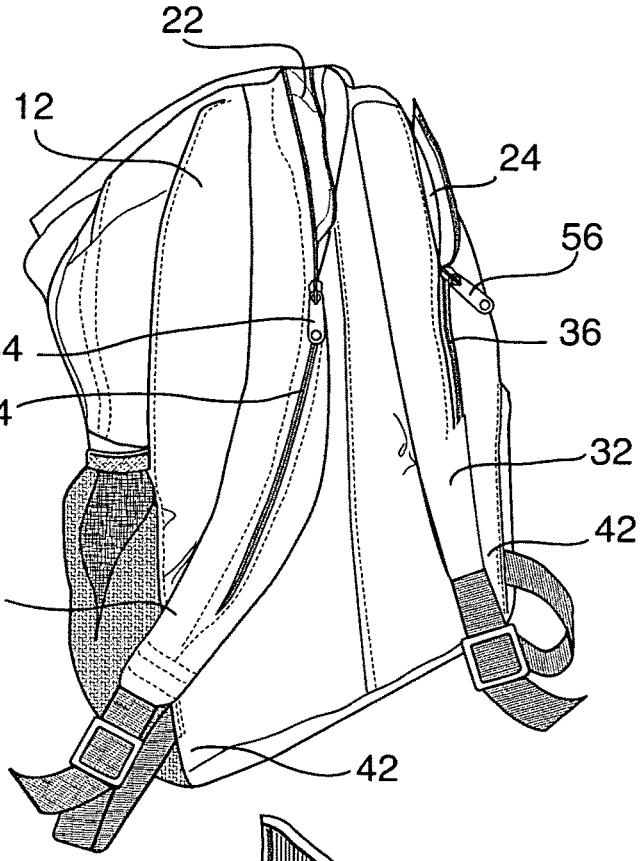
FIG. 5 is a perspective side view of the back pack with a hood compartment partially opened and the hood halves stored within the strap loops or strap sleeve compartments.
Figure 6:
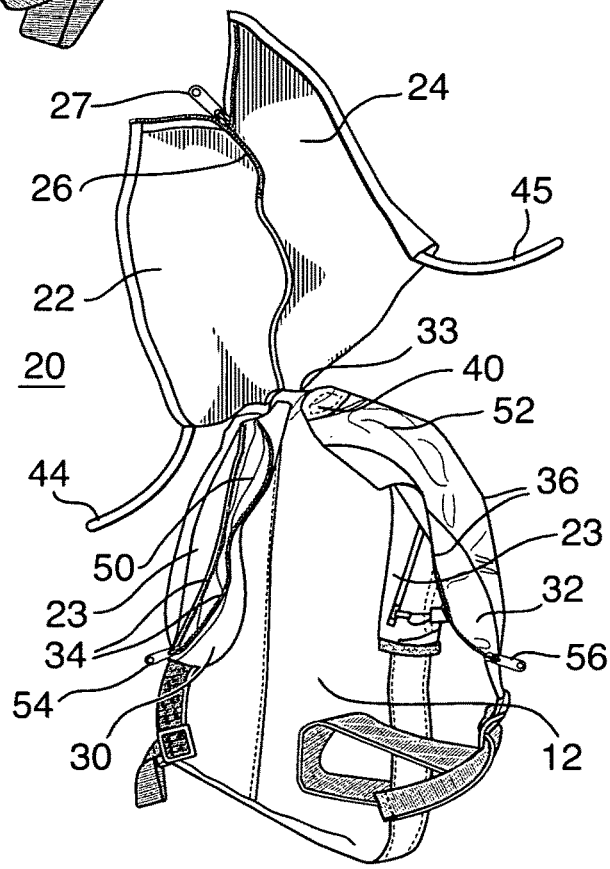
FIG. 6 is a perspective front view of the backpack with the hood within the sleeves partially assembled.
Figure 8:
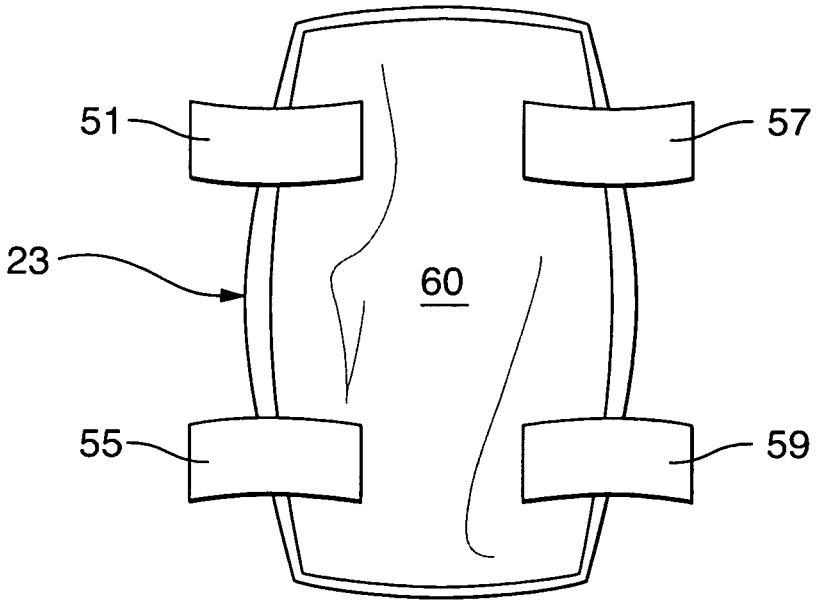
FIG. 8 is a perspective rear view of the inside surface of backpack sleeve showing the attachment tabs.

As shown in FIG. 8 the inside surface 60 of backpack sleeve shows the attachment tabs 51, 55, 57, and 59 extending from the edges thereof. The hook and loop fasteners 53 are shown in FIG. 5.

FIG. 11 is a perspective front view of a backpack book bag and a sleeve 23 attached to one of the carrying straps 32 showing the one part hood 20 deployed from the sleeve or pouch 23. The loop or sleeve 23 is removably attachable to a strap of a backpack, book bag, or other device carried by a strap extending over the shoulder of a user comprising or consisting of a longitudinal strip of tubular material containing a longitudinal storage pocket and resealable means for closure selected from the group consisting of a zipper, hook and loop fasteners, buttons and button holes, snaps, tongue and groove fastener, and overlapping flaps, the resealable means for closure extending along a selected length of the sleeve. A hood having a proximal bottom end attaches to an upper end of the sleeve. The hood is disposable in the longitudinal storage pocket of the backpack strap for storage. Upon opening the storage pocket of the at least one backpack strap the hood is removable therefrom for covering the head of the user.

The foregoing detailed description is given primarily for clearness of understanding and no unnecessary limitations are to be understood therefrom, for modification will become obvious to those skilled in the art upon reading this disclosure and may be made upon departing from the spirit of the invention and scope of the appended claims. Accordingly, this invention is not intended to be limited by the specific exemplification presented herein above. Rather, what is intended to be covered is within the spirit and scope of the appended claims.

I claim:

1. A pack strap hood consisting of:

a backpack body comprising a front side and a back side connecting to a right side and a left side connecting to a bottom panel, and at least a top portion of said back side including an opening therein, and at least one backpack strap extending from said backpack;

said at least one backpack strap including a sleeve attaching thereto comprising a longitudinal strip of tubular material containing a longitudinal storage pocket and resealable means for closure selected from the group consisting of a zipper, hook and loop fasteners, buttons and button holes, snaps, tongue and groove fastener, and overlapping flaps, said resealable means for closure extending along a selected length of said sleeve;

a hood having a proximal bottom end attaching to an upper end of said sleeve;

said hood being disposable in said longitudinal storage pocket of said at least one backpack strap for storage; and where upon opening said storage pocket of said at least one backpack strap said hood is removable therefrom for covering the head of the user.

2. A backpack, comprising:

a backpack body having a front side, a back side, a right side, a left side, a top, a bottom, a left backpack strap, a right backpack strap;

said left backpack strap having the upper free end thereof attaching at a position left of a center of an upper marginal edge of said back side of said backpack, said right backpack strap having an upper free end thereof attaching at a position to the right of said center of an upper marginal edge of said back side of said backpack, said left backpack strap having a lower free end thereof attaching to a lower marginal edge of said back side of said backpack, and said right backpack strap having a lower free end thereof attaching to a lower marginal edge of said back side of said backpack;

a hood comprising a left hood portion and a right hood portion joined together by a a hood zipper having a left side and a right side joining said left hood portion and said right hood portion, said left hood portion having a right marginal edge sewn to a left side of said hood zipper, said right hood portion having a left marginal edge sewn to a right side of said hood zipper, a lower marginal edge of said hood zipper attaching to said center of said lower marginal edge of said back side of said backpack, said hood zipper releasably holding said left hood portion and said right hood portion together for forming said hood configured to be worn on a user's head;

at least one sleeve comprising tubular material attaching to at least a portion of said left back strap and said right back strap defining a longitudinal hood storage pocket extending from said upper end, said hood storage pocket including a resealable means along the length thereof, said hood storage pocket containing a free portion of said left hood half or said right hood half respectively in a stored position;

where upon removing of said left hood portion and said right hood portion from said hood storage pocket of said at least one sleeve, said left hood portion and said right hood portion are removable therefrom and zipped together forming a hood for covering the head of the use.

3. A pack strap hood comprising:

a pack body including at least one pack strap having at least a portion thereof comprising a longitudinal strip of tubular material defining a hood storage sleeve pouch;

said pack strap sleeve pouch containing a longitudinal opening and resealable means for closure selected from the group consisting of a zipper, hook and loop fasteners, buttons and button holes, snaps, tongue and groove fastener, and overlapping flaps, said resealable means for closure extending along a selected length of said sleeve pouch defining a longitudinal storage pocket disposed within, said longitudinal storage pocket extending from an upper end of said sleeve pouch a selected distance downward therefrom;

said sleeve pouch removably extending coaxially around said pack strap, said sleeve pouch having an upper free end and a lower free end;

a hood disposed within and attaching to said sleeve pouch;

where upon opening of said storage pocket of said sleeve pouch, said hood is removable therefrom for covering the head of the user.

4. The backpack of claim 2, wherein said resealable means for closure is selected from the group consisting of a zipper, hook and loop fasteners, buttons and button holes, snaps, tongue and groove fastener, overlapping flaps, and combinations thereof.

5. A backpack, comprising:

a backpack body having a front side, a back side, a right side, a left side, a top, a bottom, a left backpack strap, a right backpack strap;

said left backpack strap having the upper free end thereof attaching at a position left of a center of an upper marginal edge of said back side of said backpack, said right backpack strap having an upper free end thereof attaching at a position to the right of said center of an upper marginal edge of said back side of said backpack, said left backpack strap having a lower free end thereof attaching to a lower marginal edge of said back side of said backpack, and said right backpack strap having a lower free end thereof attaching to a lower marginal edge of said back side of said backpack;

a hood comprising a left hood portion and a right hood portion joined together by a hood connecting means having a left side and a right side joining said left hood portion and said right hood portion, said left hood portion having a right marginal edge sewn to a left side of said hood connecting means, said right hood portion having a left marginal edge sewn to a right side of said hood connecting means, a lower marginal edge of said hood connecting means attaching to said center of said lower marginal edge of said back side of said backpack, said hood connecting means releasably holding said left hood portion and said right hood portion together for forming said hood configured to be worn on a user's head;

at least one sleeve comprising tubular material attaching to at least a portion of said left back strap and said right back strap defining a longitudinal hood storage pocket extending from said upper end, said hood storage pocket including a resealable means along the length thereof, said hood storage pocket containing a free portion of said left hood half or said right hood half respectively in a stored position;

where upon removing of said left hood portion and said right hood portion from said hood storage pocket of said at least one sleeve, said left hood portion and said right hood portion are removable therefrom connecting together forming the hood for covering the head of the user.

6. The backpack of claim 5, wherein said hood connecting means for closure is selected from the group consisting of a zipper, hook and loop fasteners, buttons and button holes, snaps, tongue and groove fastener, overlapping flaps, and combinations thereof.

7. The backpack of claim 5, wherein said resealable means for closure is selected from the group consisting of a zipper, hook and loop fasteners, buttons and button holes, snaps, tongue and groove fastener, overlapping flaps, and combinations thereof.

* * * * *